106-74 AU 118 EX
7/28/87 XR 4,683,019

United States Patent [19]

Motoki

[11] Patent Number: 4,683,019

[45] Date of Patent: Jul. 28, 1987

[54] METHOD OF FORMING REFRACTORY COATING ON STEEL FRAME

[75] Inventor: Hideo Motoki, Ibaraki, Japan

[73] Assignee: Shikoku Kaken Kogyo Kabushiki Kaisha, Osaka, Japan

[21] Appl. No.: 768,534

[22] PCT Filed: Dec. 2, 1983

[86] PCT No.: PCT/JP83/00425

§ 371 Date: Aug. 1, 1985

§ 102(e) Date: Aug. 1, 1985

[87] PCT Pub. No.: WO85/02430

PCT Pub. Date: Jun. 6, 1985

[51] Int. Cl.[4] ..... E04B 1/94

[52] U.S. Cl. ..... 156/293; 156/294; 52/309.13; 52/309.14; 52/309.15; 52/309.17; 52/344; 106/74; 106/75

[58] Field of Search ..... 156/242, 245, 293, 294, 156/278, 280, 305; 52/261, 266, 309.3, 309.5, 309.13, 309.14, 309.15, 309.16, 309.17, 344, 345, 349, 359; 106/74, 75, 76, 78, 80, 81

[56] References Cited

U.S. PATENT DOCUMENTS

| | | | |
|---|---|---|---|
| 3,230,129 | 1/1966 | Kelly | 156/294 |
| 3,802,975 | 4/1974 | Saidla | 156/245 |
| 3,830,173 | 8/1974 | Hubble et al. | 156/294 |
| 3,908,327 | 9/1975 | Quigg | 52/359 |
| 4,130,440 | 12/1978 | Nose et al. | 106/74 |
| 4,483,713 | 11/1984 | Motori | 106/75 |

*Primary Examiner*—Caleb Weston
*Attorney, Agent, or Firm*—Armstrong, Nikaido, Marmelstein & Kubovcik

[57] ABSTRACT

This invention provides a method for forming a refractory coating on a column or beam made of steel, the method comprising the steps of adhering panels directly or indirectly to the surface of the column or beam with a specific space between the panels and the column or beam and placing a self-hardening refractory composition into the space. The method of this invention is free from the drawbacks of conventional methods.

4 Claims, 7 Drawing Figures

METHOD OF FORMING REFRACTORY COATING ON STEEL FRAME

TECHNICAL FIELD

This invention relates to methods for forming refractory coatings on columns or beams made of steel, and provides methods for applying self-hardening and fire-resistant compositions to columns or beams made of steel with extreme ease and reliability to produce refractory coatings outstanding in function.

BACKGROUND ART

Refractory coating methods considered preferable are those capable of fulfilling the following requirements:

(i) giving refractory coating layers as thin as possible which results in increasing of living space in the building;

(ii) producing refractory coating layers as lightweight as possible which serve to mitigate the weight load to be supported by the lower floors of a high-rise building;

(iii) forming stable refractory coating layers;

(iv) giving refractory coatings which can exhibit good functions in the interface between the steel element and the coating, more specifically those which are unlikely to peel or flake in the interface therebetween, particularly when wetted or heated;

(v) being easy to carry out and capable of easily applying the composition even to connections between the bases to be coated;

(vi) giving coating layers which can exhibit the desired fire resistance within a short time after application;

(vii) applying the composition without scattering the same about the surrounding, hence without staining the environment;

(viii) using compositions which are easy to transport;

(ix) forming coating layers which develop no crack;

(x) requiring a small number of steps;

(xi) comprising the steps which are easy to perform;

(xii) being economical, etc.

The methods heretofore known for forming refractory coatings on steel elements include the PC method, spraying method, troweling method and concrete-placing method. The spraying method is subgrouped into dry or semi-wet spraying method and wet spraying method. These conventional coating methods have their own features but suffer drawbacks.

The molding plate method employs molding plates and has the following advantages and disadvantages. The advantages are as follows: (1) giving coatings which have constant quality because of use of molded or shaped plates manufactured in plants, not depending on the skills of operators, (2) enabling the completion of operation at a time even on bases which require 3 hours' fire resistance without involving repeated operations, (3) having the efficiency in work reduced to a lesser extent by the absence of one operator from a team usually of 3 or 4 operators than the spraying method, (4) effectively preventing the pollution from occuring due to the scatter of the composition about the environment by the wind, (5) achieving good efficiency in work because of the operation involving no scatter of composition in the environment. The disadvantages include (1) the need to study the layout and workability when setting molded plates to a complex place containing diverse kinds of steel elements and numerous connections as in elevator shafts and staircases which require cutting and adhering of shaped plates and like cumbersome labors, thereby reducing the efficiency in work, (2) the necessity of removing the adhesive forced out from between the shaped plate and the surface of the base when placing the shaped plates to nooks like return ducts as in elevator shafts and ceilings in order to prevent the adhesive forced out from being strewn in the environment, and (3) the need to use an adhesive in larger amounts to assure reliable adhesion, considering that the adhesive should not be applied in excess amount to the joint between the shaped plates when adhering shaped plates to steel elements and joining shaped plates to one another, in order to prevent undesirable shrinkage of the joint from occuring due to the vaporization of the sodium silicate during the hardening of the adhesive, the excess adhesive being unnecessary because of shaped plate units having relatively small size and involving low stress due to the heat distortion and narrow joints between shaped plates.

The PC method involves the use of precast concrete and has the advantages of saving the labor in construction site because of use of prefabricated blocks and panels and also being suitable for columns or pillars owing to the hard surface finish. On the other hand, the method possesses the drawbacks of involving the use of precast concrete elements which are cumbersome to handle in construction site because of the great weight; encountering difficulties in coping with the interlayer displacement of concrete blocks which would occur due to the high rigidity and hardness thereof, depending on the mode of application of blocks; and tending to form a layer of great thickness (low in fire resistance and heat insulation per unit thickness).

The spraying method is practiced by spraying coating compositions having an indeterminate form. The semi-wet spraying method uses a dry powdery composition with a low water content which is forced by air into the nozzle in the forward end of the spray to mix with water therein. The wet spraying method employs a liquid coating composition which is prepared by kneading with water and which is forced out by a pump. The former method is inexpensive and uses a spray device which is lightweight and easy to handle, but the method has the defects of (1) requiring thorough masking to prevent the scatter of the composition in spraying, (2) giving a layer which would peel if exposed to rain before being dried after application, (3) tending to form a layer irregular in quality without adequate quality control, (4) producing a layer susceptible to damage by ductwork or the like performed after application because of the soft layer formed and (5) involving the need to spray a finishing agent over the surface of the layer to prevent dust from evolving from the surface of the layer after hardening, depending on applied surfaces. The wet spraying method frequently uses a mixture of rock wool, cement and water and has the advantages of using coating compositions which can be pumped up to high-floor locations, leading to decrease in lifting costs and which is amenable to a base having a complicated shape. Nevertheless the method possesses the drawbacks of using coating compositions which involve difficulties in coping with the scatter of the composition in the environment and in controlling the quality, particularly the thickness of coating layer, and which require a considerable time in forming a coating with the desired hardness. The method further poses the problems of strewing the composition, consequently smearing the surrounding inside and outside the building; being carried out in poor working conditions; producing layers having low adherence to steel elements and poor corrosion resistance.

The troweling method is conducted by skillful plasterers using hand-trowels. The method can produce layers over bases of any shape and give jointless coating and pleasing finish, but provides coatings prone to develop cracks. Further the method involves an extremely low efficiency in work.

The concrete-placing method is performed by literally depositing concrete which is usally lightweight. The method has the advantages of using concrete having lightweight properties and high adherence to steel. The method suffers the shortcomings of giving coatings tending to develop cracks and thus essentially needing repair to restore the cracked portions, which presents complicated problems, such as difficulties in placing concrete into the cracks and in edge cutting, etc.

The conventional methods stated above have further drawbacks in respect of the materials used. The use of concrete materials results in layers which undergo marked contraction during hardening due to hydration of concrete, thereby involving low dimensional stability and the like. Rock wool and cement materials tend to produce coatings which are soft and which give off dust to a great degree. The method using molded plates requires additional use of adhesives which are cumbersome to handle. Plasters such as cement plaster, gypsum plaster, etc. need expanded metal lath bases. In addition, these compounds all require treatment of steel elements for corrosion prevention.

An object of this invention is to provide a method for forming refractory coatings free from the drawbacks of the foregoing conventional methods.

Another object of the invention is to provide a method for giving coatings having higher fire resistance than those formed by conventional methods.

DISCLOSURE OF THE INVENTION

This invention provides a method for forming a refractory coating to a column or beam made of steel, the method comprising the steps of (1) adhering panels directly or indirectly to the surface of the column or beam with a specific space between the column or beam and the panels and (2) placing a self hardening refractory composition into the space where the composition hardens into a layer integrally united with the column or beam and the panels. Preferably the method of this invention is carried out by using a self-hardening composition comprising as the main components (A) water-soluble alkali silicate, (B) a hardening agent for the water-soluble alkali silicate, and (C) a material containing bound water or a material capable of absorbing heat when heated and optionally (D) a metallic foaming agent (and when required, (E) a foaming stabilizer).

The method of this invention can overcome the drawbacks of the conventional methods by using the self-hardening composition, preferably the self-hardening composition comprising the components (A) to (E). More specifically, the deficiencies of conventional methods can be obviated as follows. The defects attendant on use of molded plates exist in no way with the method of this invention which employs no molded plates. The method of this invention employs adhesives but only in small amounts and thus is virtually free of the problems resulting from the use of adhesives. The difficulties arising from the PC method are not encountered with the method of the invention which uses no concrete. The problems of the dry spraying method using dry powder are not posed by the method of the invention which uses no dry powder. The method of the invention requiring no spraying can harden the surface of the layer to a specific extent in a short time and thus has no drawback in this respect found in the wet spraying method. The method of the invention is not conducted by plasterers and thus suffers no defect found in the troweling method. The method of the invention produces coatings which develop no crack unlike the concrete-placing method and therefore requires no reinforcement.

Further, the layer of composition used in the method of the invention causes little or no contraction during the hardening reaction as in concrete, and is not as soft as those produced by rock wool-cement type compositions, consequently evolving no dust. The method of the invention using no molded plate requires no adhesives for adhering the same unlike the shaped plate method. The method of the invention does not necessarily use an expanded metal lath base nor involves anti-corrosion treatment of iron element. As described hereinbefore, the method of the invention can overcome all drawbacks of the conventional refractory coating methods.

BEST EMBODIMENTS OF THE INVENTION

Figure 1A:
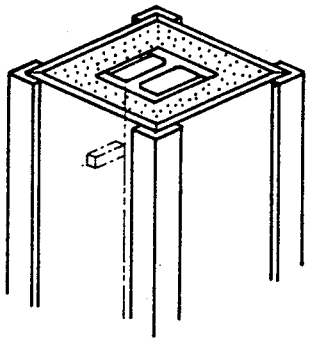
FIGS. 1*a* and 1*b* show an embodiment of the method according to this invention using a wide-flange section steel piece, and FIG. 2 an embodiment of the method according to this invention using a square steel piece.
Figure 1B:
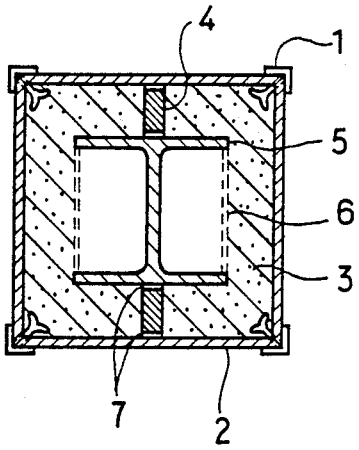

This invention will be described below in more detail with reference to the drawings. FIG. 1 shows an embodiment of the method of the invention using a wide-flange section steel piece. FIG. 1 indicates a perspective view at (a) and a cross sectional view at (b) taken on line A—A'. In FIG. 1, indicated at 1 are corner bead; 2, panel; 3, refractory self-hardening composition; 4, spacer; 5, wide-flange section steel piece; 6, backer; and 7, adhesive. First, backers 6 are adhered to the wide-flange section steel piece 5 to make the contour square. Then spacers 4 are attached to the sides of the steel piece 5 by applying an adhesive 7 to the spacers 4 and the steel piece 5 with specific spacing therebetween so that the length of the spacers corresponds to the thickness of a layer of selfhardening composition 3. A pair of panels 2 are joined to the outer ends of the spacers with the adhesive 7 and at the same time another pair of panels are attached to the first-mentioned pair to form an enclosure as shown in FIG. 1. The enclosure is reinforced in corners with corner beads 1. The self-hardening composition 3 is poured into the space between the panels 2, wide-flange section steel piece 5 and the backer 6 to harden therein.

Wide-flange section steel pieces useful in this invention can be any of those heretofore used. Usable as spacers in this invention are a wide range of those known in the art including, for example, both organic and inorganic spacers. Examples of the former are corrugated boards, plywoods, insulation boards and the like. Examples of the latter are wire nettings, gypsum boards, asbestos cement slates, cemented excelsior boards, pulp cement flat sheets, hard boards and the like. The size of the spacers may be suitably determined according to the wide-flange section steel piece. Useful adhesives are not particularly limited and can be any of organic and inorganic adhesives, examples of the former being epoxy resins and the like and examples of the latter being those of water glass-type and phosphate-type and the like. The spacers serve as supporters for forming space between the steel piece and the panels and are inoganic and relatively high in fire resistance and heat insulation. Examples of useful spacers are calcium silicate plates, foamed lightweight concrete plates, mortar plates, gypsum plates, etc. The size of the spacers in general is approximately 20 mm×20 mm. The length of the spacers is determined depending on the thickness of a layer of self-hardening composition, for example ranging from about 10 to about 40 mm. The spacers act as supporters not only for the panels but also for the self-hardening composition.

While serving as the formwork into which the self-hardening composition is poured, the panels also constitute the finish surface of the refractory coating. Panels of adequate materials are selected and used according to the thickness of self-hardening composition layer. For example, if the self-hardening composition is applied to a thickness sufficient to meet the fire resistance requirement, the kind of panels used may be adequately determined over a wide range without particular attention to the fire resistance of panels used. Specific examples of useful panels are gypsum boards, asbestos cement slates, cemented excelsior boards, pulp cement flat sheets, plywoods, particle boards, hard boards, etc. Preferred panels are those high in hardness and heat resistance and relatively small in thickness such as asbestos cement slates, decorated asbestos cement slates, decorated composite panels, etc.

The self-hardening compositions to be used in this invention are such that the composition is mixed with water to give a mixture which becomes hardened after standing at ambient temperature. Typical examples of such compositions are those comprising (A) water-soluble alkali silicate, (B) a hardening agent for the water-soluble alkali silicate and (C) a material containing bound water or a material capable of absorbing heat when heated, and those comprising the components (A) to (C) and (D) a metallic foaming agent and (E) a foaming stabilizer.

Water soluble alkali silicate is used as the component (A) for the self-hardening composition to be used in the method of this invention. Examples of the alkali forming the component (A) are lithium, sodium, potassium, rubidium and like alkali metals and quaternary ammonium compounds among which sodium, potassium and the like are inexpensive, easily available and significantly effective in promotion of foaming and hardening, hence desirable. Insofar as the component (A) is soluble in water, there is no limitation on its composition and the mole ratio of alkali oxide to $SiO_2$. However, it is preferred that the mole ratio be about 1.5 to about 4.0, particularly about 1.8 to about 3.0. With the mole ratio of 1.8 to 3.0, a foamed body is formed with significantly high water resistance and great mechanical strength. The components (A) can be used singly, or at least two of them are usable in admixture, in the form of either powder or an aqueous solution with good results. For the ease of preparation of paste, an aqueous solution is preferred which has a solids concentration of about 10% or more, usually about 10 to about 50%. In this case, a pasty composition can be easily prepared by merely mixing the aqueous solution with the other components. The resulting paste composition shrinks to a relatively lower degree during hardening.

The hardening agent for water-soluble alkali silicate used as the component (B) in this invention is at least one material selected from the group consisting of hydraulic cements, silica dusts, zinc oxides, acidic metallic oxides, bivalent or higher valent metal salts of higher fatty acids, bivalent or higher valent metal salts of water-soluble high polymers having carboxyl, phosphates, borates, sulphates of bivalent metals and sulphites of bivalent metals. Examples of hardening components are as follows. Useful hydraulic cements include hydraulic lime, natural cement, portland cement, alumina cement and like cements singly used, and lime containing cement, blast furnace cement, silica cement, fly ash cement, masonry cement, high-sulphate cement and like cements used in mixture. Typical examples of the bivalent or higher valent metal salts of higher fatty acids are zinc salts, aluminum salt, calcium salt, barium salt, magnesium salt and nickel salt of stearic acid and palmitic acid, etc. The bivalent or higher valent metal salts of water-soluble high polymers containing carboxyl are those formed of water soluble high polymers and metals, examples of the water soluble high polymers being alginic acid, polyacrylic acid, polymethacrylic acid, cellulose derivative, alkyd resin, aminoalkyd resin and the like, and examples of bivalent or higher valent metals being those selected from Zn, Cu, Ca, Mg, Be, Sr, Ba, Al, Ti, Zr, Sb, Cr, Mo, W, Sb, Mn, Fe, Co, Ni, and V. Silica dust is produced as a by-product in the preparation of silicon and silicon alloy by an electrothermal-metallurgical process. Preferred examples of silica dust are those having a particle size of about 0.1 to about 1.0$\mu$, a specific surface area of about 5 to about 50 $m^2/g$ and bulk specific gravity of about 0.1 to about 0.3 and containing 60% by weight, preferably at least about 80% by weight, of $SiO_2$. Examples of acidic metallic oxides are $Cr_2O_3$, MnO, $Mn_3O_4$, FeO, CoO, PbO, etc. Examples of phosphates are aluminum phosphate, calcium phosphate, zinc phosphate, thallium phosphate, strontium phosphate, barium phosphate, magnesium phosphate, manganese phosphate, etc. Examples of borates are zinc borate, magnesium borate, manganese borate, lead borate, nickel borate, calcium borate, etc. Examples of sulphates of bivalent metals are magnesium sulphate, zinc sulphate, calcium sulphate, barium sulphate, etc. Examples of sulphites of bivalent metals are calcium sulphite, magnesium sulphite, zinc sulphite, copper sulphite, etc.

A material containing bound water or material capable of absorbing heat when heated is used as the component (C) in this invention. The term "material containing bound water or material capable of absorbing heat when heated" refers to a material capable of giving off a large amount of the water or carbon dioxide gas present therein on application of heat at a temperature of not lower than 100° C. The foregoing material capable of emitting water, for example when heated to 600° C., can give off at least 15% by weight of water based on 100% by weight of water contained in the material at a temperature of slightly lower than 100° C. (highest temperature at which water does not evaporate). The water is contained in the material in the form of e.g., absorbed water or water of crystallization. The foregoing materials capable of giving off carbon dioxide gas are those able to emit $CO_2$ at high temperatures, for example release carbon dioxide when heated to about 900° C. Examples of the material capable of emitting water are as follows.

(1) Water containing alumina type materials such as $Al(OH)_3$, gibbsite, boehmite, diaspore, bayernite, etc.
(2) Alumina silica materials such as allophane, halloysite, unfired vermiculite, etc.
(3) Magnesia-type materials such as brusite, attapulgite, etc.
(4) Ettringite and like materials.

Typical examples of materials capable of absorbing heat are those containing carbonates such as magnesium carbonate, calcium carbonate, magnesium carbonate calcium carbonate composite materials, etc.

A material capable of giving off water and a material capable of emitting carbon dioxide gas may be conjointly used. In this case, the material capable of releasing water is used preferably in more than equivalent amount.

When required, the self-hardening composition to be used in the method of this invention can incorporate a metallic foaming agent and a foaming stabilizer to improve lightweight properties.

Examples of the metallic foaming agent used as the component (D) include various metal elements, metal alloys and intermetallic compounds. Useful metal elements can be any of those in the Groups IIB, IIIA, IIIB, IVA, IVB, VA, VB, VIB, VIIB and VIII in the Periodic Table. Preferable of these elements are those belonging to the third to fifth periods such as Cr, Mn, Ti, Zr, V, Si, Ge, Sb, Fe, Co, Ni, Cu, Zn, Al, Ca, Sn, etc. among which Ti, Zr, V, Al, Si, Ge, Sb, Zn and the like are especially preferred. Metalloid elements such as B. As and the like are also usable in this invention. Representative examples of useful alloys and intermetallic compounds (metal-to-metal compounds or metal-to-nonmetal compounds) are Al-Si, Al-Ti, Al-Mn, Al-Cu-Si, Al-Cu, Zn-S, Zn-Sn, Cu-Si, Fe-Si, Si-Ni, Co-Sb, etc. At least one of those exemplified above as the component (D) is usually used in the form of particles, preferably those having a particle size of not greater than 150μ.

Examples of the foaming stabilizer used as the component (E) in the present invention are inorganic materials selected from silica gel, zeolite, carbon black, activated carbon, talc, mica, palygorskite and sepiolite, and organic material such as surfactants (other than metallic soaps), conventional animal proteins and dimethyl silicon derivatives used heretofore as air-entraining agents for cements. Examples of useful surfactants are various and include anionic surfactants such as sodium polyoxyethylene alkyl sulfonate and sodium alkyl naphthalenesulfonate, cationic surfactants such as lauryltrimethyl ammonium chloride and like quaternary ammonium salts, nonionic surfactants such as polyoxyethylene glycol oleate and polyoxyethylene glycol laurate, ampholytic surfactants such as sodium N-alkyl-β-aminopropionate and polyoxyethylene alkyl ether phosphate, etc. These materials used as the component (E) act to uniformly disperse the component (D) in the system and to assure stabilized foaming and are therefore effective in forming uniform pores. The component (E) which is inorganic is used preferably in the form of particles having a particle size of not greater than 200μ.

Given below are the proportions of the components (A) to (C) or (A) to (E) for the self-hardening composition to be used in the method of this invention.

| | |
|---|---|
| Component (A) | 100 parts by weight |
| Component (B) | 3 to 250 parts by weight |
| Component (C) | 20 to 800 parts by weight |
| Component (D) | 0 to 50 parts by weight |
| Component (E) | 0 to 200 parts by weight |

The proportion of the component (B) ranges about 15 to about 250 parts by weight when the component used is hydraulic cement, silica dust or zinc oxide, but ranges about 3 to about 30 parts by weight, when it is bivalent or higher valent metal salt of higher fatty acid, bivalent or higher valent metal salt of water-soluble high polymer having carboxyl, acidic metallic oxide, phosphate, borate, sulphate of bivalent metal or sulphite of bivalent metal.

The proportion of the component (C) is preferably 100 to 700 parts by weight, more preferably 300 to 650 parts by weight.

The self-hardening composition of this invention which can be prepared from the components (A) to (C) may contain the component (D) to give lightweight properties. The preferred amount of the component (D) ranges from 5 to 50 parts by weight. When the component (D) is not used, the foaming stabilizer, i.e. the component (E), may be omitted although unlikely to adversely affect the system with serious result, if used. The amount of the component (E) is about 0 to about 200 parts by weight when it is inorganic but is about 0 to about 18 parts by weight when it is organic.

The self-hardening composition to be used in this invention may further contain at least one of a fibrous material (component (F)), water-soluble resin (component (G)), and inorganic swelling agent (component (H)). One of these additives, a fibrous material (component (F)), is used to give coatings having the bending strength increased by about 1.5 times and the shrinkage decreased by about twice. The component (F) is preferred to give lightweight foamed bodies. The amount of the component (F) is up to about 30 parts by weight per 100 parts by weight of the component (A) (calculated as solids). With an excess of the component (F), the composition of this invention has a reduced fluidity and particularly will not foam smoothly. Examples of fibrous materials are glass fiber, rock wool, asbestos, carbon fiber, quartz fiber, high silica fiber, aluminum silicate fiber and like inorganic fibers, and cellulose acetate fiber, polyester fiber, acrylic fiber and like organic fibers. The fibrous materials are used in the form of strands such as monofilaments, chopped strands, etc. The water-soluble resin (component (G)) mentioned above as one of the other additives is incorporated mainly to render the composition easier to handle and also serves to improve mechanical strength to some degree (20 to 30%). The amount of the component (G) is not greater than 30 parts by weight (calculated as solids) per 100 parts by weight of the component (A). An excess of the component (G) leads to reduction in the water resistance of the foamed body. Examples of the water-soluble resins are polyethylene oxide, polyethylene glycol, polyvinyl pyrrolidone and like water-soluble synthetic resins; methyl cellulose, carboxymethyl cellulose and like cellulose ethers; gelatin, gum arabic, sodium alginate, protein, starch, dextrin and like water-soluble natural resins; etc. The water soluble resins are used in the form of particles or as formulated into an aqueous solution.

Inorganic swelling agents can be added as the component (H) in this invention. This swelling agent serves to increase the fluidity of the present composition and to enhance the operational efficiency. The amount of the swelling agent is up to about 60 parts by weight per 100 parts by weight of the component (A). An excess of the component (H) leads to the composition which foams less smoothly. Examples of useful swelling agents are kaolin, bentonite, activated clay and like clays, white carbon, water-containing magnesium silicate, etc.

Other additives can be incorporated into the composition of this invention. Examples of the other additives include quartz glass, cristobalite, alumina, fly ash, calcium carbonate, siliceous powder, pottery powder, inorganic pigment, lightweight aggregate, etc. These additives are able to impart a lower bulk density and increased volume to the coating and to achieve reinforcement. Preferred examples of lightweight aggregates are organic and inorganic and include foamed particles and granules of synthetic resins prepared from vinyl chloride, phenol, urea, styrene, urethane, ethylene or the like, granules or foamed and pulverized granules of synthetic rubbers, and like organic lightweight aggregates, expanded shale, calcined pearlite, silica balloon, granular foamed silica and like inorganic lightweight aggregates, shattered foamed lightweight concrete, etc.

The amount of these additives is about 0 to about 100 parts by weight per 100 parts by weight of the component (A).

The foregoing self-hardening composition comprising the above-specified amounts of components is mixed with a suitable amount of water and the mixture is placed into the specific space.

The self-hardening composition of this invention comprising the components (A), (B) and (C) can be mixed with an air-entraining agent to form a lightweight coating. The amount of the air-entraining agent used is about 0 to about 50 parts by weight per 100 parts by weight of the component (A). The air-entraining agent may be added to an aqueous solution of the component (A) and then the components (B) and (C) may be added thereto to provide a mixture which is allowed to stand. The use of the air-entraining agent in this manner results in a lightweight coating which has a bulk specific gravity of at least about 0.7 g/cm$^3$. Although the hardened coating obtained by use of the air entraining agent has a mechanical strength a little lower than when using a metallic foaming agent, there is no problem in practical use.

The corner beads are used to give a joint between abutting panel ends in the corners of the enclosure and to reinforce the corners thereof. Useful corner beads include a variety of those known in the art, preferred examples thereof being those made of stainless steel, aluminum or the like. The corner beads can be attached to the corners of the enclosure in the conventional manner, as with an adhesive or by turning screws.

Another embodiment of the method according to this invention will be described below in detail with reference to FIG. 2.

Figure 2:
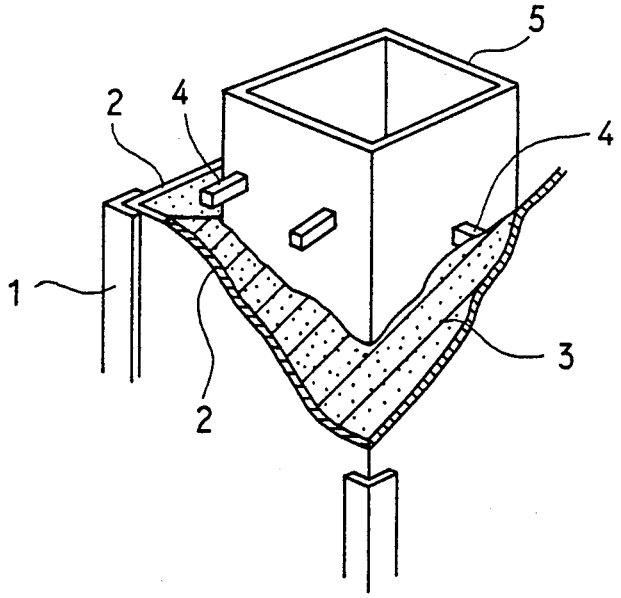

FIG. 2 shows an embodiment of the method according to this invention using a square steel piece. The reference numerals 1 to 4 represent like members in FIG. 1. Indicated at 5 is a square steel piece. No backer 6 is used herein. The self-hardening composition is poured into the space formed between the square steel piece 5 and the panels 2 in FIG. 2. The embodiment of FIG. 2 is therefore substantially the same as that using the wide-flange steel piece except for the absence of backers 6.

The method of this invention can achieve the following results.

(1) Results attainable by the method of the invention as a whole (A) The method of the invention can be carried out either in construction sites or in refractory coating plants. Particularly the method of the invention when practiced in the plant gives coatings with a high precision.

(B) The method of the invention provides coatings integrally formed with steel elements and panels and having a decorated finish.

(C) The method of the invention gives a massive construction having a great mechanical strength because it is integrally formed of panels, self-hardening composition and steel frame.

(D) The method of the invention can apply coating compositions to the specific uniform thickness so that fire resistance is exhibited virtually evenly throughout the coatings.

(E) Piping and wiring works can be done utilizing the hollow space in the steel element before application of coatings.

(F) With no spray used, the method of the invention can eliminate the possibility of staining the environment due to the scatter of the composition in application and thus can improve the environment in a marked degree.

(G) The method of the invention does not use an adhesive for application over the entire surface of steel elements so that the hardened layer of self-hardening composition possesses markedly high adherence and water resistance and thus is unlikely to peel.

(H) The method of the invention can apply layers even to complicated portions of steel elements in conformity with the shape thereof (when required by spraying or troweling).

(I) The layer formed can harden in a short time to integrally unite with the panels and the steel element.

(J) The method of the invention can produce layers which are prone to develop no crack and can apply layers in a shorter time.

Diverse results can be achieved particularly due to the use of the self-hardening composition in this invention. More specifically, the following results stem from the properties peculiar to self-hardening compositions.

(K) The layer of the composition of the invention is formed on steel elements with good adherence and will not peel from the steel elements even when subjected to high temperatures (as in a fire).

(L) The composition of the invention is applied directly to the surface of steel elements and can inhibit corrosion itself, thus eliminating the use of laths and the need for anti-corrosion treatment and consequently leading to saving of steps.

(M) The composition of the invention has such a high fire resistance that the layer formed can be thinner in specific thickness than when using conventional refractory compositions. As a result, the total thickness of the integral construction including that of the decorative panels (6 to 9 mm in thickness) is smaller than in applying conventional refractory compositions. For example, "fired vermiculite plaster" must be applied to a column to a thickness of at least 45 mm to form a layer capable of withstanding fire for 2 hours, whereas the composition of the invention can serve the same purpose by being applied to a thickness of 30 to 35 mm (composition) to which is added a thickness of 6 to 9 mm (panels), resulting in combined thickness of about 35 to about 40 mm.

(N) The composition of the invention gives a light-weight refractory layer.

The method of the present invention will be described below in more detail with reference to the following Examples.

EXAMPLE 1

Figure 3:
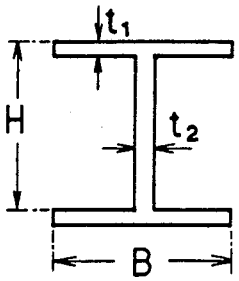
FIGS. 3–7 illustrate the steps in the method of the present invention.
Figure 4:
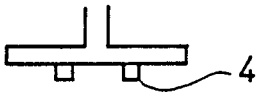
Figure 5:
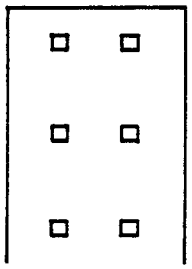
Figure 6:
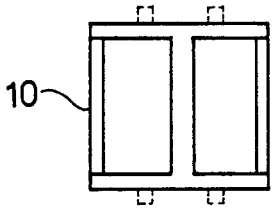
Figure 7:
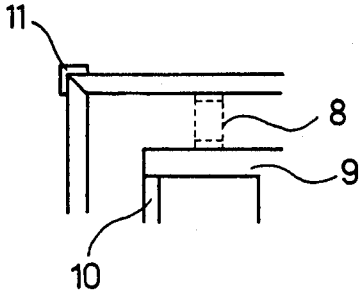

A wide-flange section steel column is used which has a height (H) of 300 mm, sides (B) of 300 mm, thickness ($t_1$) of 10 mm, thickness ($t_2$) of 15 mm and length (L) of 4,000 mm as shown in FIG. 3 according to JIS, G 3192: "Dimensions, weight and permissible variations of hot rolled steel sections". Starting with one end of the sides as shown in FIG. 4, spacers made of calcium silicate and measuring 20 mm×20 mm×30 mm (height) are adhered with an epoxy resin adhesive to the sides in parallel with one another with spacing of 100 mm between the axes of the two spacers. In FIG. 4, the arrows represent the transverse distances on the sides and the reference numeral 4 indicates the spacers. Then further spacers are adhered to the sides with spacing of 300 mm longitudinally of the sides as illustrated in FIG. 5 in which the arrows represent the longitudinal direction. Two plaster boards measuring 9 mm×280 mm×2,000 mm are each adhered as backers with an epoxy resin adhesive to the interior in the hollow space of the column longitudinally thereof as shown in FIG. 6. Two asbestos cement slates measuring 6 mm×372 mm (inside 360 mm)×2,000 mm are adhered with an adhesive to both of the sides longitudinally thereof with the spacers spanning between the column and the panels as shown in FIG. 7. Two panels of the same type are joined with an adhesive to the height portion of the column with use of stainless steel corner beads. In this way, there is formed a shuttering having hollow space surrounding the column. The reference numerals 11, 8, 9 and 10 in FIG. 7 indicate corner beads, spacers, column and backers, respectively.

Into a mortar mixer of about 300 l volume was placed 80 kg of an aqueous solution of sodium silicate having a concentration of 30% by weight and $SiO_2/Na_2O$ mole ratio of 2.5. To the solution was added a mixture of 30 kg of portland cement (commercially available product having a $CaO/SiO_2$ mole ratio of 2.55) and 120 kg of white gibbsite powder. The resulting mixture was mixed in the mortar mixer to obtain a uniform paste having a specific gravity of 1.2. The paste was poured into the hollow space in the shuttering to uniformly fill the space with the paste fully to the length of 4,000 mm. The paste used amounted to about 190 kg (about 60 kg of the paste was left unused). The paste in the shuttering hardened in about 2 hours.

The refractory coating thus obtained presented a pleasing appearance because of the asbestos cement slates attached to the surface of the coating. The slates permitted the application of a decorative coating composition commonly used in the art.

Aside from the foregoing experiment, two samples were prepared in the same manner as above using a wide-flange section steel piece having a height (H) of 300 mm, side (B) of 300 mm, thickness ($t_1$) of 10 mm, thickness ($t_2$) of 7 mm and length (L) of 1,000 mm. The following tests were conducted using the two samples thus prepared with the results shown in Table 1 below.

(1) Fire resistance test: a small-scale fire resistance test according to the method in JIS A 1304.

(2) Adhesion tests:

(i) After the corner beads were detached, the samples were tested for the adhesion in the interface between the layer of self-hardening composition and the panels according to the adhesion test in JIS A 6909.

(ii) The layer of self-hardening composition was shaved off to a thickness of about 5 mm and checked for the adhesion in the interface between the steel piece and layer according to the adhesion test in JIS A 6909.

(3) Test for resistance to saline solutions: The sample shaved as mentioned above in (2), (ii) was immersed in a 5% aqueous solution of sodium chloride for 7 days. Then the layer of self-hardening composition was removed from the steel piece to observe the surface of the steel piece.

TABLE 1

| | Result |
|---|---|
| (1) Fire resistance test | |
| (a) Deteriorative change | No deteriorative change, i.e., no abnormality |
| (b) Crack | No crack, i.e., no abnormality |
| (c) Surface temperature | 230° C. |
| (d) Highest temp. of steel | 380° C. |
| (e) Average temp. of steel | 300° C. |
| (f) Time for remaining flame | No remaining flame |
| (2) Adhesion test | |
| | (i) 1.22 kgf/cm$^2$ or more (the slate broken in its interior) (ii) 5.8 kgf/cm$^2$ |
| (3) Test for saline solutions | No corrosion over the surface of steel piece |

EXAMPLES 2 to 11

Small-size samples were prepared in the same manner as in Example 1 using a wide-flange section steel piece having a length (L) of 1,000 mm and the same type of self-hardening compositions as used in Example 1 except that the components of the kinds as shown below were employed in the amounts indicated below in Table 3. Table 4 below shows the results.

TABLE 2-1

| | Component (A) (Water-soluble alkali metal silicate) | | | |
|---|---|---|---|---|
| No. | Name of Material | $SiO_2/R_2O$* mole ratio | Conc. (%) | Remark |
| A-1 | Aqueous solution of sodium silicate | 2.5 | 30 | Product of Osaka Sodium Silicate Co., Ltd., Japan |
| A-2 | Aqueous solution of potassium silicate | 2.0 | 30 | Product of Osaka Sodium Silicate Co., Ltd., Japan |

(Note): *R stands for alkali metal.

TABLE 2-2

| Component (B) (Hardening component) | | | | |
|---|---|---|---|---|
| No. | Name of Material | Composition | Particle size (μ) | Remark |
| G-1 | Portland cement | $CaO/SiO_2 = 2.55$ | 5-100 | Product of Denki Kagaku Kogyo Kabushiki Kaisha, Japan |
| C-2 | Alumina cement | $Al_2O_3/CaO = 1.57$ | 5-100 | Product of Denki Kagaku Kogyo Kabushiki Kaisha, Japan |
| C-3 | Aluminum phosphate | Powder | 10-50 | Reagent |

TABLE 2-3

| Component (C) (Bound water-containing material) | | | |
|---|---|---|---|
| No. | Name of Material | Composition | Particle size (μ) |
| C-1 | Gibbsite | $Al_2O_3.3H_2O$ | 10-300 |
| C-2 | Halloysite | $Al(Si_2O_5)(OH)_4.2H_2O$ | 100-500 |
| C-3 | Aluminum hydroxide | $Al(OH)_3$ | 5-100 |
| C-4 | Magnesium carbonate | $MgCO_3$ | 5-100 |

TABLE 2-4

| Component (D) (Metallic Foaming agent) | | | |
|---|---|---|---|
| No. | Name of Material | Particle size (μ) | Remark |
| D-1 | Fe—Si | 5-50 | Guaranteed reagent |
| D-2 | Al | 1-50 | Product of Toyo Aluminum Co., Ltd., Japan |

TABLE 2-6

| Component (F) (Fibrous component) | | | |
|---|---|---|---|
| No. | Name of Material | Fiber (mm) | Remark |
| F-1 | Glass fiber | 3 | Staple |
| F-2 | Polypropylene fiber | 10 | Staple |

TABLE 2-7

| Component (G) (Water-soluble resin component) | | |
|---|---|---|
| No. | Name of Material | Form |
| G-1 | Hydroxyethyl cellulose | Powder |
| G-2 | Polyethylene oxide | Aqueous solution |

TABLE 2-8

| Component (H) (Inorganic swelling agent) | | |
|---|---|---|
| No. | Name of Material | Particle size (μ) |
| H-1 | Bentonite | 5-100 |
| H-2 | Anhydrous magnesium silicate | 0.5-10 |

TABLE 3

| | Ex. 2 | Ex. 3 | Ex. 4 | Ex. 5 | Ex. 6 | Ex. 7 | Ex. 8 | Ex. 9 | Ex. 10 | Ex. 11 |
|---|---|---|---|---|---|---|---|---|---|---|
| No. A-1 | 20 kg | 20 kg | 20 kg | 20 kg | 20 kg | 20 kg | 20 kg | kg | kg | 10 kg |
| No. A-2 | | | | | | | | 20 | 20 | 10 |
| No. B-1 | | | 7 | 7 | 7 | 7 | 7 | 7 | | |
| No. B-2 | 7 | | | | | | | | | 5 |
| No. B-3 | | 1 | | | | | | | 0.8 | |
| No. C-1 | 30 | 30 | | | 30 | 30 | 30 | 25 | | |
| No. C-2 | | | 30 | | | | | | 20 | |
| No. C-3 | | | | 15 | | | | | | 20 |
| No. C-4 | | | | 15 | | | | | | 10 |
| No. F-1 | | | | | 0.5 | | | | | |
| No. F-2 | | | | | | | | | | |
| No. G-1 | | | | | | 0.02 | | | | |
| No. G-2 | | | | | | | | | | |
| No. H-1 | | | | | | | 2.5 | | | |
| No. H-2 | | | | | | | | | | |

TABLE 4

| | Ex. 2 | Ex. 3 | Ex. 4 | Ex. 5 | Ex. 6 | Ex. 7 | Ex. 8 | Ex. 9 | Ex. 10 | Ex. 11 |
|---|---|---|---|---|---|---|---|---|---|---|
| (1)-1 | No ab. | No ab. | No ab. | No ab. | No ab. | No ab. | No ab. | No ab. | No ab. | No ab. |
| (1)-2 | No ab. | No ab. | No ab. | No ab. | No ab. | No ab. | No ab. | No ab. | No ab. | No ab. |
| (1)-3 | 220° C. | 240° C. | 240° C. | 250° C. | 230° C. | 230° C. | 220° C. | 230° C. | 240° C. | 240° C. |
| (1)-4 | 360° C. | 380° C. | 390° C. | 420° C. | 380° C. | 370° C. | 380° C. | 390° C. | 400° C. | 370° C. |
| (1)-5 | 280° C. | 300° C. | 310° C. | 340° C. | 300° C. | 300° C. | 300° C. | 310° C. | 310° C. | 300° C. |
| (1)-6 | No rf. | No rf. | No rf. | No rf. | No rf. | No rf. | No rf. | No rf. | No rf. | No rf. |
| (2)-1 | 11.4 $Kgf/cm^2$ | 13.5 | 12.0 | 1.5 | 12.3 | 14.1 | 10.3 | 12.2 | 12.4 | 11.5 |
| (2)-2 | 4.3 | 5.4 | 5.1 | 4.7 | 5.2 | 5.8 | 4.9 | 5.5 | 6.2 | 5.4 |
| (3) | No ab. | No ab. | No ab. | No ab. | No ab. | No ab. | No ab. | No ab. | No ab. | No ab. |

(Note: No ab. stands for no abnormality, and No rf. is short for no remaining flame.)

TABLE 2-5

| Component (E) (Foaming stabilizer) | | |
|---|---|---|
| No. | Name of Material | Particle size (μ) |
| E-1 | Silica gel | 5-50 |
| E-2 | Polyoxyethylene nonylphenyl ether | — |

EXAMPLES 12 to 21

These Examples employed the same type of self-hardening compositions as used in Example 1 with the exception of using the components of the kinds, including the metallic foaming agent and foaming stabilizer, as shown below in Table 5. The small-size samples (with wide-flange section steel pieces having a length (L) of 1,000 mm) used in Examples 12 to 21 were prepared in the same manner as in Example 1. However, in Example 12, tests were carried out using a sample having a wide-flange section steel column with a length (L) of 4,000 mm which was made as follows. The composition was partly poured into the hollow space in the shuttering in an amount sufficient to fill the space to a height of about 500 mm. The layer thus formed expanded and hardened in 2 hours to a length of about 1,000 mm. Then the composition was partly poured into the space in such amount as to fill the space to a height of about 500 mm and was left to stand for 2 hours. The same procedure was repeated 4 times to provide the steel column having a length of 4,000 mm and surrounded with a refractory layer. The foamed and hardened body in the hollow space was evenly cellular and extended over the distance of 4,000 mm to provide a uniform refractory coating.

Small size samples were prepared from the components in the amounts listed below in Table 5 and tested with the results indicated later in Table 6.

TABLE 5

| | Ex. 12 | Ex. 13 | Ex. 14 | Ex. 15 | Ex. 16 | Ex. 17 | Ex. 18 | Ex. 19 | Ex. 20 | Ex. 21 |
|---|---|---|---|---|---|---|---|---|---|---|
| No. A-1 | 20 | 20 | 20 | 20 | | 20 | | 20 | | 20 |
| No. A-2 | | | | | 20 | | 20 | | 25 | |
| No. B-1 | 7 | 7 | 7 | | | 5 | 7 | 7 | 7 | 7 |
| No. B-2 | | | | 5 | | | | | | |
| No. B-3 | | | | | 5 | | | | | |
| No. C-1 | 30 | 30 | 30 | | | 25 | 25 | 25 | 25 | 25 |
| No. C-2 | | | | 30 | | | | | | |
| No. C-3 | | | | | 30 | | | | | |
| No. D-1 | 0.6 | | 0.5 | | 0.8 | 0.3 | | 0.8 | 0.8 | 0.8 |
| No. D-2 | | 0.5 | | 0.5 | | | 1.5 | | | |
| No. E-1 | 4 | 4 | | | | 2 | 6 | 4 | 4 | 4 |
| No. E-2 | | | 0.1 | 0.1 | 0.1 | | | | | |
| No. F-1 | | | | | | | | | | |
| No. F-2 | | | | | | | | 0.5 | | |
| No. G-1 | | | | | | | | | | |
| No. G-2 | | | | | | | | | 0.02 | |
| No. H-1 | | | | | | | | | | |
| No. H-2 | | | | | | | | | | 2.5 |

TABLE 6

| | Ex. 12 | Ex. 13 | Ex. 14 | Ex. 15 | Ex. 16 | Ex. 17 | Ex. 18 | Ex. 19 | Ex. 20 | Ex. 21 |
|---|---|---|---|---|---|---|---|---|---|---|
| Foaming time (min) | 30 | 30 | 35 | 40 | 35 | 30 | 30 | 35 | 30 | 30 |
| Bulk specific gravity of layer | 0.7 | 0.8 | 0.8 | 0.8 | 0.6 | 0.7 | 0.8 | 0.9 | 0.7 | 0.8 |
| Uniformity of cells | Good | Good | Good | Good | Good | Good | Good | Good | Good | Good |
| (1)-1 | No ab. | No ab. | No ab. | No ab. | No ab. | No ab. | No ab. | No ab. | No ab. | No ab. |
| (1)-2 | No ab. | No ab. | No ab. | No ab. | No ab. | No ab. | No ab. | No ab. | No ab. | No ab. |
| (1)-3 | 230° C. | 230° C. | 240° C. | 230° C. | 230° C. | 240° C. | 220° C. | 220° C. | 230° C. | 240° C. |
| (1)-4 | 390° C. | 380° C. | 400° C. | 390° C. | 390° C. | 380° C. | 370° C. | 390° C. | 400° C. | 400° C. |
| (1)-5 | 290° C. | 300° C. | 310° C. | 300° C. | 300° C. | 300° C. | 290° C. | 280° C. | 310° C. | 290° C. |
| (1)-6 | No rf. | No rf. | No rf. | No rf. | No rf. | No rf. | No rf. | No rf. | No rf. | No rf. |
| (2)-1 | 6.1 | 5.8 | 6.2 | 6.4 | 4.3 | 5.7 | 4.9 | 6.3 | 6.1 | 5.2 |
| (2)-2 | 3.5 | 4.2 | 3.8 | 3.9 | 2.7 | 3.5 | 3.2 | 4.1 | 4.3 | 3.3 |
| (3) | No ab. | No ab. | No ab. | No ab. | No ab. | No ab. | No ab. | No ab. | No ab. | No ab. |

(Note: No ab. stands for no abnormality, and No rf. for no remaining flame.)

I claim:

1. A method for forming a refractory coating on a steel column or steel beam serving as a structural member of a building, the method comprising the steps of (1) adhering panels directly or indirectly to the surface of the steel column or steel beam with provision for a hollow space between the surface of the steel column or steel beam and the panels and (2) pouring a pasty self-hardening refractory composition into the hollow space in which the composition hardens into a layer integrally united with the panels and the steel column or steel beam, wherein the self-hardening refractory composition comprises:

(A) at least one water-soluble alkali silicate, (B) a hardener for the water-soluble alkali silicate, and (C) at least one material selected from the group consisting of a material containing bound water and a material capable of absorbing heat when heated.

2. A method as defined in claim 1 wherein spacers are attached to the panels and the surface of the column or beam before placing the self-hardening refractory composition into the space.

3. A method as defined in claim 1 or 2 wherein the self-hardening refractory composition comprises:

water-soluble alkali silicate, a hardener for the water-soluble alkali silicate, a metallic foaming agent, and a foaming stabilizer when required.

4. A method as defined in claim 1 wherein in addition to the components (A) to (C), the self-hardening refractory composition further comprises (D) a metallic foaming agent and (E) a foaming stabilizer when required.

* * * * *